US008337750B2

(12) United States Patent
Jablokov et al.

(10) Patent No.: US 8,337,750 B2
(45) Date of Patent: Dec. 25, 2012

(54) TITANIUM ALLOYS INCLUDING INCREASED OXYGEN CONTENT AND EXHIBITING IMPROVED MECHANICAL PROPERTIES

(75) Inventors: Victor R. Jablokov, Charlotte, NC (US); Howard L. Freese, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 500 days.

(21) Appl. No.: 11/268,922

(22) Filed: Nov. 8, 2005

(65) Prior Publication Data

US 2007/0193662 A1 Aug. 23, 2007

Related U.S. Application Data

(60) Provisional application No. 60/716,460, filed on Sep. 13, 2005.

(51) Int. Cl.
*C22C 14/00* (2006.01)

(52) U.S. Cl. ..... 420/421; 148/421

(58) Field of Classification Search ..... 148/421; 420/417–421

See application file for complete search history.

(56) References Cited

U.S. PATENT DOCUMENTS

| | | | | |
|---|---|---|---|---|
| 2,857,269 | A | | 10/1958 | Vordahl |
| 3,313,138 | A | | 4/1967 | Spring et al. |
| 3,489,617 | A | | 1/1970 | Wuerfel |
| 3,615,378 | A | | 10/1971 | Bomberger, Jr. et al. |
| 3,635,068 | A | | 1/1972 | Watmough et al. |
| 3,686,041 | A | | 8/1972 | Lee |
| 4,040,129 | A | * | 8/1977 | Steinemann et al. ..... 424/422 |
| 4,053,330 | A | | 10/1977 | Henricks et al. |
| 4,067,734 | A | | 1/1978 | Curtis et al. |
| 4,094,708 | A | | 6/1978 | Hubbard et al. |
| 4,098,623 | A | | 7/1978 | Ibaraki et al. |
| 4,197,643 | A | * | 4/1980 | Burstone et al. ..... 433/20 |
| 4,229,216 | A | | 10/1980 | Paton et al. |
| 4,309,226 | A | | 1/1982 | Chen |
| 4,482,398 | A | | 11/1984 | Eylon et al. |
| 4,543,132 | A | | 9/1985 | Berczik et al. |
| 4,631,092 | A | | 12/1986 | Ruckle et al. |
| 4,668,290 | A | | 5/1987 | Wang et al. |
| 4,687,290 | A | | 8/1987 | Prussas |
| 4,688,290 | A | | 8/1987 | Hogg |

(Continued)

FOREIGN PATENT DOCUMENTS

EP 0 707 085 B1 7/1999

(Continued)

OTHER PUBLICATIONS

Lampman, S., "Wrought and Titanium Alloys," ASM Handbooks Online, ASM International, 2002. (PDF is 20 pages total.).*

(Continued)

*Primary Examiner* — Scott Kastler
*Assistant Examiner* — Vanessa Luk
(74) *Attorney, Agent, or Firm* — K & L Gates LLP; Patrick J. Viccaro; John E. Grosselin, III

(57) ABSTRACT

One aspect of the present disclosure is directed to a metastable β titanium alloy comprising, in weight percentages: up to 0.05 nitrogen; up to 0.10 carbon; up to 0.015 hydrogen; up to 0.10 iron; greater than 0.20 oxygen; 14.00 to 16.00 molybdenum; titanium; and incidental impurities. Articles of manufacture including the alloy also are disclosed.

26 Claims, 6 Drawing Sheets

U.S. PATENT DOCUMENTS

| | | | |
|---|---|---|---|
| 4,714,468 | A | 12/1987 | Wang et al. |
| 4,799,975 | A | 1/1989 | Ouchi et al. |
| 4,808,249 | A | 2/1989 | Eyelon et al. |
| 4,842,653 | A | 6/1989 | Wirth et al. |
| 4,851,055 | A | 7/1989 | Eylon et al. |
| 4,857,269 | A | 8/1989 | Wang et al. |
| 4,889,170 | A | 12/1989 | Mae et al. |
| 4,975,125 | A | 12/1990 | Chakrabarti et al. |
| 4,980,127 | A | 12/1990 | Parris et al. |
| 5,026,520 | A | 6/1991 | Bhowal et al. |
| 5,032,189 | A | 7/1991 | Eylon et al. |
| 5,074,907 | A | 12/1991 | Amato et al. |
| 5,080,727 | A | 1/1992 | Aihara et al. |
| 5,141,566 | A | 8/1992 | Kitayama et al. |
| 5,156,807 | A | 10/1992 | Nagata et al. |
| 5,162,159 | A | 11/1992 | Tenhover et al. |
| 5,169,597 | A | 12/1992 | Davidson et al. |
| 5,173,134 | A | 12/1992 | Chakrabarti et al. |
| 5,201,457 | A | 4/1993 | Kitayama et al. |
| 5,244,517 | A | 9/1993 | Kimura et al. |
| 5,264,055 | A | 11/1993 | Champin et al. |
| 5,277,718 | A | 1/1994 | Paxson et al. |
| 5,332,454 | A | 7/1994 | Meredith et al. |
| 5,342,458 | A | 8/1994 | Adams et al. |
| 5,358,586 | A | 10/1994 | Schutz et al. |
| 5,442,847 | A | 8/1995 | Semiatin et al. |
| 5,472,526 | A | 12/1995 | Gigliotti, Jr. |
| 5,516,375 | A | 5/1996 | Ogawa et al. |
| 5,545,268 | A | 8/1996 | Yashiki et al. |
| 5,679,183 | A | 10/1997 | Takagi et al. |
| 5,698,050 | A | 12/1997 | El-Soudani |
| 5,795,413 | A | 8/1998 | Gorman |
| 5,871,595 | A | 2/1999 | Ahmed et al. |
| 5,897,830 | A | 4/1999 | Abkowitz et al. |
| 5,954,724 | A | 9/1999 | Davidson |
| 6,127,044 | A | 10/2000 | Yamamoto et al. |
| 6,132,526 | A | 10/2000 | Carisey et al. |
| 6,139,659 | A | 10/2000 | Takahashi et al. |
| 6,187,045 | B1 | 2/2001 | Fehring et al. |
| 6,200,685 | B1 | 3/2001 | Davidson |
| 6,250,812 | B1 | 6/2001 | Ueda et al. |
| 6,258,182 | B1 | 7/2001 | Schetky et al. |
| 6,284,071 | B1 | 9/2001 | Suzuki et al. |
| 6,332,935 | B1 | 12/2001 | Gorman et al. |
| 6,387,197 | B1 | 5/2002 | Bewlay et al. |
| 6,391,128 | B2 | 5/2002 | Ueda et al. |
| 6,409,852 | B1 | 6/2002 | Lin et al. |
| 6,536,110 | B2 | 3/2003 | Smith et al. |
| 6,539,607 | B1 | 4/2003 | Fehring et al. |
| 6,558,273 | B2 | 5/2003 | Kobayashi et al. |
| 6,632,304 | B2 | 10/2003 | Oyama et al. |
| 6,663,501 | B2 | 12/2003 | Chen |
| 6,773,520 | B1 | 8/2004 | Fehring et al. |
| 6,800,153 | B2 | 10/2004 | Ishii et al. |
| 7,611,592 | B2 | 11/2009 | Davis et al. |
| 7,837,812 | B2 | 11/2010 | Marquardt et al. |
| 2001/0050117 | A1 | 12/2001 | Oyama et al. |
| 2003/0168138 | A1 | 9/2003 | Marquardt |
| 2004/0055675 | A1 | 3/2004 | Kuramoto et al. |
| 2004/0099350 | A1 | 5/2004 | Mantione et al. |
| 2005/0257864 | A1 | 11/2005 | Marquardt et al. |
| 2005/0284549 | A1 | 12/2005 | Woodfield et al. |
| 2007/0193018 | A1 | 8/2007 | Davis et al. |
| 2010/0307647 | A1 | 12/2010 | Marquardt et al. |
| 2011/0038751 | A1 | 2/2011 | Marquardt et al. |

FOREIGN PATENT DOCUMENTS

| | | | |
|---|---|---|---|
| EP | 1 083 243 | A2 | 3/2001 |
| EP | 1 612 289 | A | 1/2006 |
| GB | 2 337 762 | A | 12/1999 |
| JP | H01-279736 | A | 11/1989 |
| JP | H05-195175 | A | 8/1993 |
| JP | H09-215786 | A | 8/1997 |
| JP | 11-343528 | A | 12/1999 |
| JP | 11-343548 | A | 12/1999 |
| JP | 2003-55749 | A | 2/2003 |
| JP | 2003-74566 | A | 3/2003 |
| WO | WO 98/22629 | A | 5/1998 |

OTHER PUBLICATIONS

Boyer, Rodney R., "Introduction and Overview of Titanium and Titanium Alloys: Applications," Metals Handbook, ASM Handbooks Online (2002).*

Callister, Jr., William D., Materials Science and Engineering, An Introduction, Sixth Edition, John Wiley & Sons, pp. 180-184 (2003).*

"Heat Treating of Nonferrous Alloys: Heat Treating of Titanium and Titanium Alloys," Metals Handbook, ASM Handbooks Online (2002).*

S. Lampman, "Wrought Titanium and Titanium Alloys," vol. 2: Properties and Selection: Nonferrous Alloys and Special-Purpose Materials, ASM Handbook, 1990, pp. 592-633.*

Marc Long and H.J. Rack, "Titanium alloys in total joint replacement—a materials science perspective," Biomaterials, 19 (1998), pp. 1621-1639.*

Kathy Wang, "The use of titanium for medical applications in the USA," Materials Science and Engineering A, 213 (1996), pp. 134-137.*

Roach, M.D. et al. "Comparison of the Corrosion Fatigue Characteristics of CPTi-Grade 4, Ti-6A1-4V ELI, Ti-6A1-7 Nb, and Ti-15 Mo", *Journal of Testing and Evaluation*, vol. 2, Issue 7 (Jul./Aug. 2005) (published online Jun. 8, 2005).

Jablokov, et al., "The Application of Ti-15 Mo Beta Titanium Alloy in High Strength Orthopaedic Applications", *Journal of ASTM International*, vol. 2, Issue 8 (Sep. 2005) (published online Jun. 22, 2005).

Marquardt, et al., "Beta Titanium Alloy Processed for High Strength Orthopaedic Applications," *Journal of ASTM International*, vol. 2, Issue 9 (Oct. 2005) (published online Aug. 17, 2005).

Pending U.S. Appl. No. 10/165,348, filed Jun. 7, 2002.

Nutt, Michael J., et al. "The Application of Ti-15 Beta Titanium Alloy in High-Strength Structural Orthopaedic Applications," *Program and Abstracts for the Symposium on Titanium, Niobium, Zirconium, and Tantalum for Medical and Surgical Applications*, Washington D.C., Nov. 9-10, 2004 Abstract, p. 12.

Marquart, Brian, "Ti-15Mo Beta Titanium Alloy Processed for High Strength Orthopaedic Applications," *Program and Abstracts for the Symposium on Titanium, Niobium, Zirconium, and Tantalum for Medical and Surgical Applications*, Washington D.C., Nov. 9-10, 2004 Abstract, p. 11.

Marquart, Brian, "Characterization of Ti-15Mo for Orthopaedic Applications," TMS 2005 Annual Meeting: Technical Program, San Francisco, CA, Feb. 13-17 2005 Abstract, p. 239.

Qazi, J.I. et al. "High-Strength Metastable Beta-Titanium Alloys for Biomedical Applications," *JOM*, Nov. 2004 pp. 49-51.

Tokaji, Keiro et al., "The Microstructure Dependence of Fatigue Behavior in Ti-15Mo-5Zr-3AI Alloy," *Materials Science and Engineering A*, vol. 213 (1996) pp. 86-92.

Allegheny Ludlum, *High Performance Metals for Industry, High Strength, High Temperature, and Corrosion-Resistant Alloys*, (2000) pp. 1-8.

Disegi, John, *Wrought Titanium—15% Molybdenum Implant Material*, Original Instruments and Implants of the Association for the Study of Internal Fixation—AO ASIF, Oct. 2003 pp. 1-26.

Naik, Uma M. et al., "Omega and Alpha Precipitation in Ti-15Mo Alloy," *Titanium '80 Science and Technology—Proceedings of the 4th International Conference on Titanium*, H. Kimura & O. Izumi Eds. May 19-22, 1980 pp. 1335-1341.

Pennock, G.M. et al., "The Control of a Precipitation by Two Step Ageing in β Ti-15Mo," *Titanium '80 Science and Technology—Proceedings of the 4th International Conference on Titanium*, H. Kimura & O. Izumi Eds. May 19-22, 1980 pp. 1344-1350.

Bowen, A. W., "On the Strengthening of a Metastable β-Titanium Alloy by ω- and α-Precipitation" *Royal Aircraft Establishment Technical Memorandum Mat 338*, (1980) pp. 1-15 and Figs 1-5.

Bowen, A. W., "Omega Phase Embrittlement in Aged Ti-15%Mo," *Scripta Metallurgica*, vol. 5, No. 8 (1971) pp. 709-715.

"ASTM Designation F2066-01 Standard Specification for Wrought Titanium-15 Molybdenum Alloy for Surgical Implant Applications (UNS R58150)," ASTM International (2000) pp. 1-4.
Disegi, J. A., "Titanium Alloys for Fracture Fixation Implants," *Injury International Journal of the Care of the Injured*, vol. 31 (2000) pp. S-D14-17.
Ho, W.F. et al., "Structure and Properties of Cast Binary Ti-Mo Alloys" *Biomaterials*, vol. 20 (1999) pp. 2115-2122.
*ASM Materials Engineering Dictionary*, J.R. Davis Ed., ASM International, Materials Park, OH (1992) p. 39.
*Metal Handbook, Desk Edition. 2nd Ed.* J.R. Davis ed., ASM International, Materials Park, OH (1998) pp. 575-578.
Allvac, Product Specification for "Allvac Ti-15 Mo," available at http://www.allvac.com/allvac/pages/Titanium/Ti15MO.htm, last visited Jun. 9, 2003 p. 1 of 1.
Lemons, Jack et al., "Metallic Biomaterials for Surgical Implant Devices," *BONEZone*, Fall (2002) p. 5-9 and Table.
"ASTM Designation F1801-97 Standard Practice for Corrosion Fatigue Testing of Metallic Implant Materials" ASTM International (1997) pp. 876-880.
Zardiackas, L.D. et al., "Stress Corrosion Cracking Resistance of Titanium Implant Materials," *Transactions of the 27th Annual Meeting of the Society for Biomaterials*, (2001) p. 438.
SAE Aerospace Material Specification 4897A (issued Jan. 1997, revised Jan. 2003).
Roach, M.D. et al., "Physical, Metallurgical, and Mechanical Comparison of a Low-Nickel Stainless Steel," Transactions of the 27th Annual Meeting of the Society for Biomaterials, Apr. 24-29, 2001, p. 343.
Roach, M.D. et al., "Stress Corrosion Cracking of a Low-Nickel Stainless Steel," Transactions of the 27th Annual Meeting of the Society for Biomaterials, 2001, p. 469.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Jablokov et al, "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
ATI Ti-15Mo Beta Titanium Alloy Technical Data Sheet, ATI Ailvac, Monroe, NC, Mar. 21, 2008, 3 pages.
G. Lüttering and J.C. Williams, *Titanium*, Springer, New York (2nd ed. 2007) page 24.
J.L. Murray, The Mn-Ti (Manganese-Titanium) System, Bulletin of Alloy Phase Diagrams, vol. 2, No. 3 (1981) p. 334-343.
Bradley et al., "Optimization of Melt Chemistry and Properties of 35Cobalt-35Nickel-20Chromium-10Molybdenum Alloy Medical Grade Wire", ASM International M&PMD Conference, Anaheim, California. Sep. 8, 2003, 7 pages.
"Corrosion of Titanium and Titanium Alloys", Key to Metals Nonferrous, printed from http:www.key-to-nonferrous.com/Print.aspx?id=CheckArticle&LN=EN&NM=24, 1999, 4 pages.
"Fabrication of Aerospace Titanium and Titanium Alloys", printed from http.//www.aviation-database.com/Aerospace_titanium_and_titanium_alloys.htm on Jul. 17, 2008, 4 pages.
"Titanium Alloy Classification", printed from http://www.markusfarkus.com/reference/titanium.htm on Nov. 22, 2010, 6 pages.
Shortkroff, et al., "In Vitro Biocompatibility of TiOsteum," Society for Biomaterials, 28th Annual Meeting Transactions, Brigham and Women's Hospital and Harvard Medical School, Boston, Apr. 2002, p. 341.
Semiatin, S.L. et al., "The Thermomechanical Processing of Alpha/Beta Titanium Alloys," *Journal of Metals*, Jun. 1997, pp. 33-36.
Weiss, I. et al., "Thermomechanical Processing of Beta Titanium Alloys—An Overview," *Material Science and Engineering*, A243, 1998, pp. 49-57.
Weiss, I. et al., "The Processing Window Concept of Beta Titanium Alloys", *Recrystallization '90*, ed. by T. Chandra, *The Minerals, Metals & Materials Society*, 1990, pp. 609-616.
Froes, F.H. et al., "The Processing Window for Grain Size Control in Metastable Beta Titanium Alloys", *Beta Titanium Alloys in the 80's*, ed. by R. Boyer and H. Rosenberg, *AIME*, 1984, pp. 161-164.
Myers, J., "Primary Working, A lesson from Titanium and its Alloys," ASM Course Book 27 Lesson, Test 9, Aug. 1994, pp. 3-4.
Metals Handbook, Desk Edition, 2nd ed., J. R. Davis ed., ASM International, Materials Park, Ohio (1998), pp. 575-588.
Tamirisakandala, S. et al., "Strain-induced Porosity During Cogging of Extra-Low Interstitial Grade Ti-6AI-4V", *Journal of Materials Engineering and Performance*, vol. 10(2), Apr. 2001, pp. 125-130.
Prassad, Y.V.R.K. et al. "Hot Deformation Mechanism in Ti-6AI-4V with Transformed B Starting Microstructure: Commercial v. Extra Low Interstitial Grade", *Materials Science and Technology*, Sep. 2000, vol. 16, pp. 1029-1036.
Russo, P.A., "Influence of Ni and Fe on the Creep of Beta Annealed Ti-6242S", Titanium '95: Science and Technology, pp. 1075-1082.
Williams, J., Thermo-mechanical processing of high-performance Ti alloys: recent progress and future needs, Journal of Material Processing Technology, 117 (2001), p. 370-373.
Lutjering, G. and Williams, J.C., Titanium, Springer-Verlag, 2003, Ch. 5: Alpha+Beta Alloys, p. 177-201.
Fedotov, S.G. et al., "Effect of Aluminum and Oxygen on the Formation of Metastable Phases in Alloys of Titanium with .beta.-Stabilizing Elements", Izvestiya Akademii Nauk.
(FEDOTOV cont.) SSSR, Metally, 1974, pp. 121-126.
Long, M. et al., "Friction and Surface Behavior of Selected Titanium Alloys During Reciprocating-Sliding Motion", Wear, 249(1-2), 158-168, (2001).
Takemoto Y et al., "Tensile Behavior and Cold Workability of Ti-Mo Alloys", Materials Transactions Japan Inst. Metals Japan, vol. 45, No. 5, May 2004, pp. 1571-1576.
"Datasheet: Timetal 21S", *Alloy Digest, Advanced materials and Processes* (Sep. 1998), pp. 38-39, (1998).
"Stryker Orthopaedics TMZF® Alloy (UNS R58120)", printed from www.allvac.com/allvac/pages/Titanium/UNSR58120.htm, Nov. 7, 2005.
ASTM Designation F 2066-01, "Standard Specification for Wrought Titanium-15 Molybdenum Alloy for Surgical Implant Applications (UNS R58150)".
"Technical Data Sheet: Allvac® Ti-15Mo Beta Titanium Alloy" (dated Jun. 16, 2004).
Unpublished U.S. Appl. No. 11/057,614, filed Feb. 14, 2005, entitled "Metastable Beta-Titanium Alloys and Methods of Processing the Same by Direct Aging".

* cited by examiner

TITANIUM ALLOYS INCLUDING INCREASED OXYGEN CONTENT AND EXHIBITING IMPROVED MECHANICAL PROPERTIES

The present application claims priority under 35 U.S.C. §119(e) from co-pending U.S. Patent Application Ser. No. 60/716,460, filed on Sep. 13, 2005.

BACKGROUND OF THE TECHNOLOGY

1. Field of Technology

The present disclosure relates to fatigue resistant titanium-base alloys and articles of manufacture including the alloys.

2. Description of the Background of the Technology

There are approximately 30 different metallic biomaterials that have been used or that are being considered for use to manufacture implantable medical and surgical devices. These distinctly different metallic biomaterials are differentiated by their chemical compositions and by their mechanical and metallurgical properties as defined by international ASTM Standards, ISO Standards, and UNS designations. The 30 metallic biomaterials can be categorized into four groups: stainless steels (iron-base alloys); cobalt-base alloys; titanium grades; and specialty grades.

Before the advent of implantable orthopedic and cardiovascular devices, metallic materials had first been developed for use in applications in other industries in which corrosion resistance and heat-resistance was needed. Certain improved corrosion resistant stainless steels developed for the chemical industry and certain cobalt-base alloys developed for the aerospace industry are examples of cross-industry application of metallurgical technology to the earliest medical implants for total joint arthroplasty. Dr. John Charnley's pioneering work with stainless steel hip stems in the 1960s was followed by experimentation with titanium and zirconium materials. Those early materials that were proven successful in medical device applications were defined in the first ASTM F04 "metallurgical materials" standards (ASTM F04.12), and those standards were derived from published chemical industry and aerospace industry standards. These early "medical" materials were later designated as "grandfathered" material grades in ASTM F 763 (see Table 1) and are commonly considered, each on its own merit, as a reference metallic biomaterial against which any new implantable metallic biomaterial is compared.

TABLE 1

| Common Name | ASTM and ISO Standards | UNS Number(s) |
|---|---|---|
| Unalloyed Titanium Grades CP-1, 2, 3, 4 | ASTM F 67, ISO 5832-2 | R50250, 400, 550, 700 |
| Co—28Cr—6Mo Castings and Casting Alloy | ASTM F 75, ISO 5832-4 | R30075 |
| Co—20Cr—15W—10Ni—1.5Mn ("L-605") Alloy | ASTM F 90, ISO 5832-5 | R30605 |
| Ti—6Al—4V ELI Alloy | ASTM F 136, ISO 5832-3 | R56401 |
| Fe—18Cr—14Ni—2.5Mo ("316 LS") Alloy | ASTM F 138, ISO 5832-1 | S31673 |
| 35Co—35Ni—20Cr—10Mo ("MP-35N") Alloy | ASTM F 562, ISO 5832-6 | R30035 |

In the last 15 years, there have been important additions of new alloys to each of the four basic metals groups as improved and new biomedical devices and applications have been developed. Three newer wrought stainless steel alloys, listed below in Table 2, are now being used in approved medical and surgical devices. Table 2 also lists certain trade names that have been used with the alloys. Criteria for these stainless steel grades included improved corrosion fatigue properties, reduced nickel content, and ductility similar to or improved over existing biomedical stainless steel grades. All three of these alloys were the subject of patents, which have since expired.

TABLE 2

| |
|---|
| Fe—21Cr—12.5Ni—5Mn—2.5Mo ("XM-19", ASTM F 1314, UNS S20910) |
| Fe—22Cr—10Ni—3.5Mn—2.5Mo ("REX 734", ASTM F 1586, UNS S31695) |
| Fe—23Mn—21Cr—1Mo—1N ("108", ASTM F 2229, UNS S29108) |

Certain important alloy development projects directed to cobalt-base alloy systems have resulted in novel chemistry and processing advances and improved cobalt-base alloys. One such development project applied an older alloy that had been used as a spring wire in the Swiss watch industry to biomedical applications, followed by like application of two fairly similar grades. See ASTM F 563, "Standard Specification for Wrought Cobalt-20 Nickel-20 Chromium-3.5 Molybdenum-3.5 Tungsten-5 Iron Alloy for Surgical Implant Applications (UNS R30563)"; and ASTM F 1058, "Standard Specification for Wrought 40 Cobalt-20 Chromium-16 Iron-15 Nickel-7 Molybdenum Alloy Wire and Strip for Surgical Implant Applications", Annual Book of ASTM Standards. Subsequently, three variations on the cast Co-28Cr-6Mo alloy were developed, and each is covered by a wrought CoCrMo alloy standard, ASTM F 1537. The ASTM F 1537 standard was an outgrowth of the ASTM F 799 standard, which was originally for a forging and machining alloy having a chemistry almost identical to the ASTM F 75 standard, which is for the casting alloy and castings. Alloy #3 in the ASTM F 1537 standard represents a CoCrMo grade with small additions of aluminum and lanthanum oxides. Patents for this gas atomized, dispersion strengthened ("GADS") alloy discuss methods of manufacture and improved properties of the alloy in the forged and sintered conditions. See U.S. Pat. Nos. 4,714,468 and 4,687,290. More recently, several patents were issued for a single-phase ASTM F 1537 Alloy #1 with improved high cycle fatigue properties. See U.S. Pat. Nos. 6,187,045, 6,539,607, and 6,773,520. Similarly, a higher fatigue version of the 35Co-35Ni-20Cr-10Mo (ASTM F 562) alloy has been introduced for wrought and drawn product forms. See Bradley, et al. "Optimization of Melt Chemistry and Properties of 35 Cobalt-35 Nickel-20 Chromium-10 Molybdenum Alloy (ASTM F 562) Medical Grade Wire," ASM International M&PMD Conference, Anaheim, Calif., September 2003. Various alloys discussed above and related common trade names are listed below in Table 3.

TABLE 3

| |
|---|
| Co—20Ni—20Cr—5Fe—3.5Mo—3.5W—2Ti<br>("Syncoben", ASTM F 563, UNS R30563) |
| Co—20Cr—15Ni—15Fe—7Mo—2Mn<br>("Elgiloy", ASTM F 1058, UNS R30003) |
| Co—19Cr—17Ni—14Fe—7Mo—1.5Mn<br>("Phynox", ASTM F 1058, UNS R30008) |
| Co—28Cr—6Mo<br>("GADS", ASTM F 1537, Alloy #3, UNS R31539) |
| Co—28Cr—6Mo<br>("No-Carb", ASTM F 1537, Alloy #1, UNS R31537) |
| 35Co—35Ni—20Cr—10Mo<br>("35N LT", ASTM F 562) |

Significant change has occurred in the use of titanium and titanium alloys and the number of new titanium materials and product forms the medical device designer has from which to select. Since the early 1990s, several new ASTM standards for titanium-base alloy biomaterials have been developed by the "Metallurgical Materials" Subcommittee, ASTM F-04.12. These consensus standards, listed below in Table 4, have been balloted and approved by the "Medical and Surgical Materials and Devices" Main Committee, F-04. One such standard, ASTM F 1295, is directed to an α+β titanium alloy, which originally was invented in Switzerland and has intrinsic properties similar to the two "Ti-6-4" alloys, but uses niobium instead of vanadium as a P stabilizing alloying element. A second new standard, ASTM F 1472, is directed to biomaterial applications of the most widely produced aerospace titanium grade, Ti-6Al-4V alloy (UNS R56400).

ASTM F 1713 and F 1813, working through subcommittees simultaneously, were for two entirely new metastable β titanium alloys with properties designed by medical device manufacturing companies specifically for structural orthopedic implant applications. The ASTM F 2066 standard was developed for the metastable β titanium alloy, titanium-15 molybdenum (Ti-15Mo). ASTM F 2146 covers low-alloy α+β Ti-3Al-2.5V tubing used for medical devices, which is based on a product used for aerospace hydraulic tubing for more than 40 years.

TABLE 4

| Common Name | ASTM/ISO | Microstructure | UNS Number |
|---|---|---|---|
| Ti—5Al—2.5Fe Alloy ("Tikrutan") | ISO 5832-10 | α + β | unassigned |
| Ti—6Al—7Nb Alloy ("TAN") | ASTM F 1295, ISO 5832-11 | α + β | R56700 |
| Ti—6Al—4V Alloy | ASTM F 1472, ISO 5832-3 | α + β | R56400 |
| Ti—13Nb—13Zr Alloy | ASTM F 1713 | metastable β | R58130 |
| Ti—12Mo—6Zr—2Fe Alloy ("TMZF") | ASTM F 1813 | metastable β | R58120 |
| Ti—15Mo Alloy | ASTM F 2066 | metastable β | R58150 |
| Ti—3Al—2.5V Alloy (tubing only) | ASTM F 2146 | α + β | R56320 |
| Ti—35Nb—7Zr—5Ta Alloy "TiOsteum" | Sub. F-04.12.23 | metastable β | R58350 |

Another metastable β titanium alloy, Ti-35Nb-7Zr-5Ta, was developed specifically for structural orthopedic implants, such as total hip and total knee systems, with the objectives of overcoming some of the technical limitations of the three established α+β titanium alloys. With titanium, niobium, zirconium, and tantalum as alloying elements, the superior corrosion resistance and osseointegratabilty of this alloy have been demonstrated. See Hawkins, et al., "Osseointegration of a New Beta Titanium Alloy as Compared to Standard Orthopaedic Implant Materials," No. 1083, Sixth World Biomaterials Congress, Society for Biomaterials, May 2000; Shortkroff, et al., "In Vitro Biocompatibility of TiOsteum," No. 341, Society for Biomaterials, Brigham and Women's Hospital and Harvard Medical School, April 2002.

Despite the wide variety of titanium-base and other biomaterials currently available and being developed, there remains a need for further improved materials for medical and surgical applications. For example, improvements in cyclic fatigue strength and certain other mechanical properties of biocompatible titanium-base materials would be particularly helpful in fabricating improved medical implants subjected to high and/or cyclic stresses. Any such improved alloys, however, must still provide sufficient ductility appropriate for the intended application for the medical or surgical device. For example, orthopaedic surgeons in trauma cases may need to shape bone plate implants made of these improved alloys to suit the needs of the patients (for example, intraoperative contouring of metal plates or rods). Improved alloys also must exhibit a suitable modulus of elasticity so as to sufficiently replicate the performance of the human bones or tissues they replace or repair.

More generally, there remains a need for titanium-base alloys having improved properties and/or reduced production cost and which may be used in one or more of a variety of applications including, for example, biomedical, aerospace, automotive, nuclear, power generation, costume jewelry, and chemical processing applications.

SUMMARY

One aspect of the present disclosure is directed to a metastable β titanium alloy comprising, in weight percentages: up to 0.05 nitrogen; up to 0.10 carbon; up to 0.015 hydrogen; up to 0.10 iron; greater than 0.20 oxygen; 14.00 to 16.00 molybdenum; titanium; and incidental impurities.

A further aspect of the present disclosure is directed to a metastable β titanium alloy comprising, in weight percentages: up to 0.05 nitrogen; up to 0.10 carbon; up to 0.015 hydrogen; up to 0.10 iron; greater than 0.20 oxygen; 14.00 to 16.00 molybdenum; at least 83.54 titanium; and incidental impurities.

Another aspect of the present disclosure is directed to a metastable β titanium alloy consisting essentially of, in weight percentages: up to 0.05 nitrogen; up to 0.10 carbon; up to 0.015 hydrogen; up to 0.10 iron; greater than 0.20 oxygen; 14.00 to 16.00 molybdenum; at least 83.54 titanium; and incidental impurities.

Yet another aspect of the present disclosure is directed to a metastable β titanium alloy consisting of, in weight percentages: up to 0.05 nitrogen; up to 0.10 carbon; up to 0.015 hydrogen; up to 0.10 iron; greater than 0.20 oxygen; 14.00 to 16.00 molybdenum; at least 83.54 titanium; and incidental impurities.

An additional aspect of the present disclosure is directed to a metastable β titanium alloy having a novel chemistry as described in the present disclosure and which, with the exception of oxygen content, has the composition of UNS R58150.

Yet an additional aspect of the present disclosure is directed to a metastable β titanium alloy having a novel chemistry as described in the present disclosure and which, with the exception of oxygen content and the provisions of Section 9.1 under "Special Requirements" requiring a fully recrystallized beta phase structure, satisfies all of the requirements of ASTM F 2066-01 for wrought. Ti-15Mo alloy suitable for use in the manufacture of surgical implants.

A further aspect of the present disclosure is directed to a metastable β titanium alloy having a novel chemistry as described in the present disclosure, and wherein the alloy has at least one of yield strength and ultimate tensile strength that is greater than for a second alloy processed in an identical manner and, with one exception, having an identical chemistry, wherein the one exception is that second alloy includes no greater than 0.20 weight percent oxygen.

Yet a further aspect of the present disclosure is directed to a metastable β titanium alloy having a novel chemistry as described in the present disclosure, and wherein the alloy has improved cyclic fatigue properties relative to a second alloy processed in an identical manner and, with one exception, having an identical chemistry, wherein the one exception is that the second alloy includes no greater than 0.20 weight percent oxygen.

Other aspects of the present disclosure are directed to articles of manufacture comprising a metastable β titanium alloy having any of the novel compositions described herein. Such articles of manufacture include, for example, equipment and parts used in one or more of the following applications: medical, surgical, aerospace, automotive, nuclear, power generation, jewelry, and chemical processing applications. In one particular non-limiting embodiment, the article of manufacture is a surgical implant device or a part therefor. Specific non-limiting examples of possible surgical implant devices and parts with which embodiments of the alloys described in the present disclosure may be used include: components for partial and total hip and knee replacement; intermedullary rods; fracture plates, spinal fixation and spinal disc replacement components; trauma plates and screws; wires and cables; fasteners and screws; nails and anchors; dental castings, implant posts, appliances, and single tooth implants; orthodontic arch wires and anchors; heart valve rings and components; profile and plate stocks; tools and instruments; and miscellaneous fasteners and hardware. Specific non-limiting examples of possible non-surgical equipment and parts with which embodiments of the alloys described herein may be used include: automotive torsion bars; aerospace fasteners; corrosion-resistant thin sheet for military and commercial aircraft; high performance racing and motorcycle springs; and corrosion-resistant chemical processing tubing and fasteners.

BRIEF DESCRIPTION OF THE DRAWINGS

Features and advantages of the alloys and articles of manufacture described herein may be better understood by reference to the accompanying drawings in which.

DETAILED DESCRIPTION OF NON-LIMITING EMBODIMENTS

Figure 1:
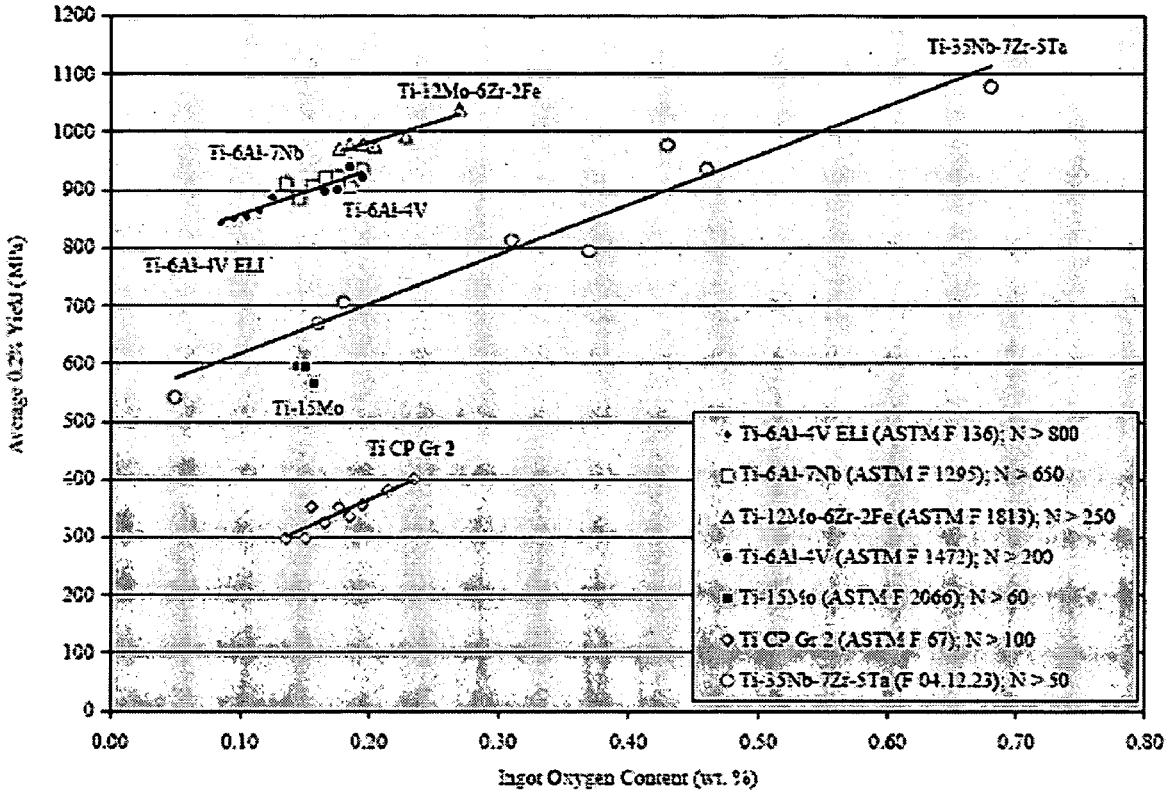
FIG. 1 is a graph plotting average 0.2% yield strength as a function of oxygen content for samples of CP titanium Grade 2 and several titanium alloys.

The present inventors have concluded that the composition of a common titanium-base biomedical alloy can be modified to improve certain properties of the alloy important for medical device, surgical device, and other applications. More specifically, the inventors considered the influence of oxygen on mechanical properties of various titanium-base alloys and, extrapolating from that data, determined that increasing the oxygen content of Ti-15Mo alloy above the 0.20 weight percent limit listed in ASTM F 2066 may actually improve fatigue properties of the alloy, thereby improving alloy performance in various medical and surgical device applications, as well as in other applications. As discussed below, a study of laboratory data held by ATI Allvac (Monroe, N.C.) related to eight titanium grades and alloys (α, α+β, and metastable β) was undertaken to investigate whether a correlation exists between yield strength (YS) and oxygen content. For medical, surgical, and certain other applications, structural titanium alloys must have very favorable high cycle fatigue properties. In titanium alloys, fatigue strength correlates well with YS. Accordingly, the inventors have relied on the general relationship they have observed between oxygen content and YS for the eight titanium grades and alloys to ascertain the relationship between oxygen content and fatigue properties in Ti-15Mo alloy. More particularly, the inventors have relied on the observed general relationship between oxygen content and YS for the eight considered titanium grades and alloys to ascertain whether fatigue properties of Ti-15Mo alloy will be improved by increasing the alloy's oxygen content above the maximum established in ASTM F 2066. As described below, the present inventors also performed tests confirming that improvements in the mechanical properties of Ti-15Mo alloy occur with increases in alloy oxygen content above the maximum content listed in ASTM F 2066-01.

1. Chemistry of Certain Titanium-Base Metallic Biomaterials

Table 5 provides the chemistries as specified in the relevant ASTM specifications for several commercially important titanium grades and alloys, including commercially pure, α+β, and metastable β titanium grades. For each grade or alloy, minima and maxima are listed for each specified alloying element, interstitial, and trace-level impurity element (if any). The side-by-side comparison shown in Table 5 reveals that, in general, the specifications having higher maximum oxygen limits are associated with the grades having greater alloy contents. One meaningful measure of the alloy content is obtained by calculating the "Titanium, average" value listed in Table 5, which is the arithmetic average of the specified minimum and maximum limits of titanium content (by difference) for each grade or alloy, according to the appropriate ASTM standard. Subtracting this value from unity, a measure of the alloy content (which includes interstitials) results, listed in Table 5 as "Ave. Alloy Content". Ti-35Nb-7Zr-5Ta, which has an average alloy content of 48.83%, specifies a maximum oxygen content of 0.75%, while T-6Al-4V ELI, which has an average alloy content of 10.26%, specifies a maximum oxygen content of 0.13%.

The specified chemistry data in Table 5 demonstrate, numerically, differences between the CP titanium grades (α microstructure), the three listed α+β titanium alloys, and three listed metastable β titanium alloys. Although there are significant chemical, mechanical, corrosion resistance, and osseointegratabilty differences between the four CP titanium grades (all having a microstructure), the group is represented solely by Ti CP-4 (UNS R50700) so that differences among the CP grades and the other considered grades can be more readily seen.

2. Oxygen Content of Titanium-Base Metallic Biomaterials

Oxygen content influences the strength and ductility levels of the four CP titanium grades, with a doubling of oxygen from 0.18% for CP grade 1 to 0.40% for CP grade 4, resulting in an almost threefold increase in the specified minimum YS, from 172 MPa for grade 1 to 483 MPa for grade 4. Elongation decreases from 24% for grade 1 to 15% for grade 4.

There are differences in both oxygen and alloy contents for the three α+β titanium alloys listed in Table 5. Ti-6Al-4V ELI and Ti-6Al-4V have specified maximum oxygen contents and minimum specified YS values of 0.13% and 795 MPa, and 0.20% and 860 MPa, respectively. Ti-6Al-7Nb is slightly more highly alloyed than Ti-6Al-4V and Ti-6Al-4V ELI (about 13% vs. about 10%), and has a specified maximum oxygen content of 0.20% and a minimum specified YS of 800 MPa.

Three metastable β titanium alloys used in medical and surgical applications are included in Table 5. Two of the three alloys are from the Ti—Mo group of alloys (Ti-12Mo-6Zr-2Fe (UNS R58120) and Ti-15Mo (UNS R58150)), and the third alloy is a Ti—Nb alloy (Ti-35Nb-7Zr-5Ta (R58350)). Both the specified oxygen maxima and the alloy content values for the three alloys are relatively large. This is generally true for other commercially available metastable β titanium alloys used in the aerospace industry, and particularly so for Ti-3Al-8V-6Cr-4Mo-4Zr (UNS R58640), which has a specified maximum oxygen content and an alloy content of 0.25% and about 25%, respectively. The three metastable P alloys listed in Table 5 have alloy content values of about 20%, about 15%, and about 47%. Table 6 summarizes the specified minimum and maximum oxygen levels for all three of these metastable β grades, along with values for the three α+β alloys and CP grade titanium. Note that the maximum oxygen content values for Ti-12Mo-6Zr-2Fe and Ti-35Nb-7Zr-5Ta are considerably greater than for the three α+β alloys.

TABLE 5

| | Ti-CP-4 ASTM F 67 (Grade 4) | | Ti—6Al—4V ELI ASTM F 136 | | Ti—6Al—7Nb ASTM F 1295 | | Ti—6Al—4V ASTM F 1472 | |
|---|---|---|---|---|---|---|---|---|
| Element | (min) | (max) | (min) | (max) | (min) | (max) | (min) | (max) |
| Nitrogen | | 0.05 | | 0.05 | | 0.05 | | 0.05 |
| Carbon | | 0.08 | | 0.08 | | 0.08 | | 0.08 |
| Hydrogen | | 0.015 | | 0.012 | | 0.009 | | 0.015 |
| Iron | | 0.50 | | 0.25 | | 0.25 | | 0.30 |
| Oxygen | | 0.40 | | 0.13 | | 0.20 | | 0.20 |
| Aluminum | | | 5.50 | 6.50 | 5.50 | 6.50 | 5.50 | 6.75 |
| Vanadium | | | 3.50 | 4.50 | | | 3.50 | 4.50 |
| Yttrium | | | | | | | | 0.005 |
| Niobium | | | | | 6.50 | 7.50 | | |
| Molybdenum | | | | | | | | |
| Zirconium | | | | | | | | |
| Tantalum | | | | | | 0.50 | | |
| Titanium b (by 0) | 100.00 | 98.96 | 91.00 | 88.478 | 88.00 | 84.91 | 91.00 | 88.10 |
| Total | 100.00 | 100.00 | 100.00 | 100.00 | 100.00 | 100.00 | 100.00 | 100.00 |
| Titanium, ave. | 99.48% | | 89.74% | | 86.46% | | 89.55% | |
| Ave. Alloy Content | 0.52% | | 10.26% | | 13.54% | | 10.45% | |

| | Ti—12Mo—6Zr—2Fe ASTM F 1813 | | Ti—15Mo ASTM F 2066 | | Ti—35Nb—7Zr—5Ta F 04.12.23 | |
|---|---|---|---|---|---|---|
| Element | (min) | (max) | (min) | (max) | (min) | (max) |
| Nitrogen | | 0.05 | | 0.05 | | 0.02 |
| Carbon | | 0.05 | | 0.10 | | 0.02 |
| Hydrogen | | 0.020 | | 0.015 | | 0.020 |
| Iron | 1.50 | 2.50 | | 0.10 | | 0.25 |
| Oxygen | 0.008 | 0.28 | | 0.20 | | 0.75 |
| Aluminum | | | | | | |
| Vanadium | | | | | | |
| Yttrium | | | | | | |
| Niobium | | | | | 34.00 | 37.00 |
| Molybdenum | 10.00 | 13.00 | 14.00 | 16.00 | | |
| Zirconium | 5.00 | 7.00 | | | 6.30 | 8.30 |
| Tantalum | | | | | 4.50 | 6.50 |
| Titanium b (by 0) | 83.49 | 77.10 | 86.00 | 83.54 | 55.20 | 47.14 |
| Total | 100.00 | 100.00 | 100.00 | 100.00 | 100.00 | 100.00 |
| Titanium, ave. | 80.30% | | 84.77% | | 51.17% | |
| Ave. Alloy Content | 19.70% | | 15.23% | | 48.83% | |

TABLE 6

| Common Name | UNS Designation | Oxygen (% min.) | Oxygen (% max.) | Oxygen (% ave.) | Titanium (% ave.) |
|---|---|---|---|---|---|
| Ti CP-4 | R50700 | 0.0 | 0.40 | 0.20 | 99.48 |
| Ti—6Al—4V ELI | R56401 | 0.0 | 0.13 | 0.065 | 89.74 |
| Ti—6Al—7Nb | R56700 | 0.0 | 0.20 | 0.10 | 86.46 |
| Ti—6Al—4V | R56400 | 0.0 | 0.20 | 0.10 | 89.55 |
| Ti—12Mo—6Zr—2Fe | R58210 | 0.008 | 0.28 | 0.144 | 80.30 |
| Ti—15Mo | R58150 | 0.0 | 0.20 | 0.10 | 84.77 |
| Ti—35Nb—7Zr—5Ta | R58350 | 0.0 | 0.75 | 0.375 | 51.17 |

3. Correlating Yield Strength and Oxygen Content for Production Ingots

Most of the titanium semi-finished mill products delivered into medical and surgical device pathways is manufactured in very large mill production lots as either round billet, round bar, round rod (small diameter bar cut to length), or rod coil stock for re-draw applications (such as wire and bone plate stocks). Similarly, most of the Ti-3Al-8V-6Cr-4Mo-4Zr alloy for aerospace and automotive applications is also manufactured as semi-finished long product by the titanium mills or their converters, whereas others produce finished goods from these so-called long products (as opposed to "flat products," which includes sheet, plate, and strip product forms). Ti-10V-2Fe-3Al alloy is manufactured predominantly as a round "billet" product, a large diameter intermediate product that can be forged directly into the large truck beam components in landing gear assemblies. Some Ti-10V-2Fe-3Al alloy, however, is manufactured in the long product form and is used for brake rods in commercial aircraft.

An investigation was undertaken using production laboratory analytical data to determine whether any relationship exists between oxygen content and YS. The production laboratory data of ATI Allvac (Monroe, N.C.) were used. ATI Allvac has manufactured each of the CP, $\alpha+\beta$, and metastable $\beta$ titanium materials listed in Tables 5 and 6 as semi-finished mill product for use in both aerospace and biomedical applications and has, over the years, analyzed the chemistries and ascertained certain mechanical properties for those commercial products. To the inventors' knowledge, no one before has assembled data on the chemistry and certain mechanical properties for such a wide array of titanium alloys used in biomedical and surgical applications. A search was conducted of ATI Allvac's proprietary laboratory on-line files for the seven ASTM compositions listed in Tables 5 and 6 for semi-finished mill product of each alloy in generally the same condition and processed on the same or similar equipment and generally using the same production routes. By sorting through the large body of data held by ATI Allvac, a large sample was obtained, thereby allowing one to consider, in a statistically meaningful manner, whether any correlation exists between YS and oxygen content for such alloys.

The influence of ingot oxygen content on the average YS of the various titanium and titanium alloy metallic biomaterials is shown in FIG. 1. Each data point represents a "batch" of consolidated and averaged yield data from one or numerous ingots/heats having identical ingot oxygen content. The ingot oxygen content listed for each data point is the certified ingot oxygen level. FIG. 1 reveals a comparison of mill product data in the mill annealed condition for various round bar product diameters that, as mentioned above, have been similarly manufactured and conform to the applicable biomedical specifications. Each alloy was plasma arc or vacuum arc melted, press and rotary forged to intermediate billet, hot rolled to round bar or coil, and finish machined. The corresponding average YS data are listed in Table 7, and the standard error computed by regression analysis (a measure of the data spread) is listed in Table 8.

TABLE 7

| Ti—35Nb—7Zr—5Ta | | Ti—15Mo | | Ti—12Mo—6Zr—2Fe | | Ti CP Grade 2 | |
|---|---|---|---|---|---|---|---|
| Ingot O (wt. %) | Ave. YS (MPa) | Ingot O (wt. %) | Ave. YS (MPa) | Ingot O (wt. %) | Ave. YS (MPa) | Ingot O (wt. %) | Ave. YS (MPa) |
| 0.05 | 542 | 0.14 | 596 | 0.18 | 972 | 0.14 | 297 |
| 0.16 | 669 | 0.15 | 594 | 0.19 | 979 | 0.15 | 299 |
| 0.18 | 706 | 0.16 | 568 | 0.20 | 978 | 0.16 | 353 |
| 0.31 | 813 | | | 0.21 | 974 | 0.17 | 325 |
| 0.37 | 794 | | | 0.23 | 992 | 0.18 | 352 |
| 0.43 | 977 | | | 0.27 | 1038 | 0.19 | 336 |
| 0.46 | 937 | | | | | 0.20 | 356 |
| 0.68 | 1078 | | | | | 0.22 | 381 |
| | | | | | | 0.24 | 401 |

| Ti—6Al—7Nb | | Ti—6Al—4V | | Ti—6A1—4V ELI | |
|---|---|---|---|---|---|
| Ingot O (wt. %) | Ave. 0.2% Yield (MPa) | Ingot O (wt. %) | Ave. 0.2% Yield (MPa) | Ingot O (wt. %) | Ave. 09.2% Yield (MPa) |
| 0.14 | 911 | 0.17 | 897 | 0.09 | 843 |
| 0.15 | 886 | 0.18 | 901 | 0.10 | 850 |
| 0.16 | 907 | 0.19 | 940 | 0.11 | 853 |
| 0.17 | 921 | 0.20 | 921 | 0.12 | 864 |
| 0.18 | 922 | | | 0.13 | 887 |
| 0.19 | 904 | | | | |
| 0.20 | 934 | | | | |

TABLE 8

| | Ti—35Nb—7Zr—5Ta | Ti—15Mo | Ti—12Mo—6Zr—2Fe | Ti CP Gr 2 | Ti—6Al—7Nb | Ti—6Al—4V | Ti—6Al—4V ELI |
|---|---|---|---|---|---|---|---|
| St. Err. (MPa) | ±30 | N/A | ±22 | ±29 | ±42 | ±42 | ±42 |

The comparison shown in FIG. 1 is meant to be a "macro" representation of the influence of oxygen content on the yield properties of various titanium grades and alloys. Therefore, as mentioned above, each data point represents the average of all yield strength data collected for each oxygen content and ignores minor variances in processing parameters such as, for example, rolling temperature, mill anneal temperature, and final bar size. Subsequently, over 2000 data points were analyzed to generate FIG. 1. Based on the curves plotted in FIG. 1 by regression analysis, it can be seen that average 0.2% YS varies with the alloy's content of oxygen for the considered CP titanium grade and titanium alloys. More specifically, as the oxygen level increases so does YS. FIG. 1 also allows the interstitial strengthening contribution of oxygen to be predicted over a range of ingot oxygen levels for various titanium alloys.

4. An Example: Ti-35Nb-7Zr-5Ta Metastable β Titanium Alloy

A close consideration of data plotted in FIG. 1 for Ti-35Nb-7Zr-5Ta metastable β titanium alloy is instructive. For oxygen levels in the range of 0.16% to 0.38%, Ti-35Nb-7Zr-5Ta exhibited lower YS than all of the alloys plotted other than Ti CP Grade 2 and Ti-15Mo metastable β alloy. For oxygen levels between 0.38% and 0.62%, the span of the YS range for Ti-35Nb-7Zr-5Ta corresponds to the sum of the YS ranges of the α+β alloys (Ti-6Al-4V ELI, Ti-6Al-4V, and Ti-6Al-7Nb) and the Ti-12Mo-6Zr-2Fe metastable β alloy in the figure. For oxygen levels above 0.62%, YS of Ti-35Nb-7Zr-5Ta exceeds that of all of the other alloys plotted in the figure. As a result, a broad YS range is achievable for Ti-35Nb-7Zr-5Ta alloy by varying the ingot oxygen content.

Figure 2:
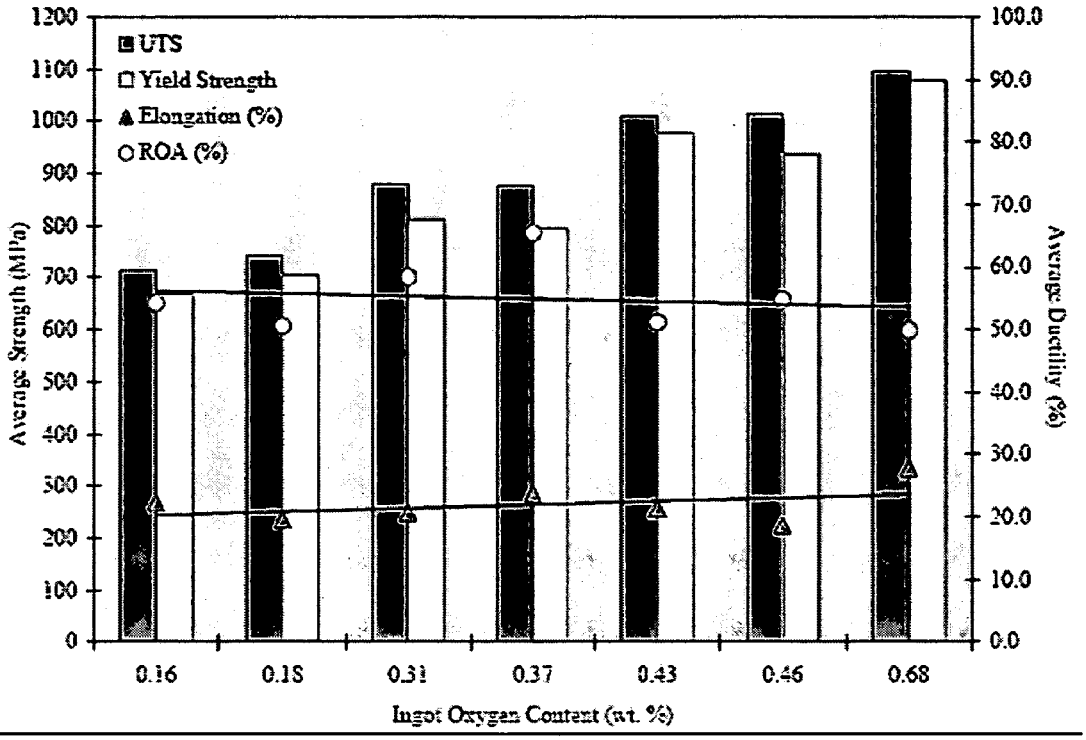
FIG. 2 is a graph plotting several tensile properties as a function of oxygen content for samples of Ti-35Nb-7Zr-5Ta alloy.

A more detailed view of Ti-35Nb-7Zr-5Ta tensile data is shown in FIG. 2. The figure plots ultimate tensile stress (UTS), YS, elongation, and reduction of area (ROA) as a function of ingot oxygen content. As in FIG. 1, each data column/point consists of an average of all available mill annealed test data from various mill product forms for a specific ingot oxygen level. FIG. 2 confirms the relationship of strength and oxygen content seen in FIG. 1. As oxygen content increases from 0.16% to 0.68%, UTS increases from 715 MPa to 1096 MPa, and YS increases from 669 MPa to 1077 MPa. The increases are also shown in Table 9 below. Significantly, ductility of the alloy does not decrease as UTS and YS increase with increasing ingot oxygen content. The ductility (elongation or "EL") of Ti-35Nb-7Zr-5Ta is greater than 18.5% throughout the entire oxygen range studied.

TABLE 9

| Ingot Oxygen (wt. %) | YS (MPa) | UTS (MPa) | Elongation (%) | ROA (%) |
|---|---|---|---|---|
| 0.16 | 669 | 715 | 22.2 | 54.3 |
| 0.18 | 706 | 742 | 19.5 | 50.6 |
| 0.31 | 812 | 880 | 20.7 | 58.5 |
| 0.37 | 876 | 794 | 23.7 | 65.5 |
| 0.43 | 977 | 1011 | 21.3 | 51.2 |
| 0.46 | 936 | 1013 | 18.7 | 54.8 |
| 0.68 | 1077 | 1096 | 27.7 | 49.9 |

Figure 3:
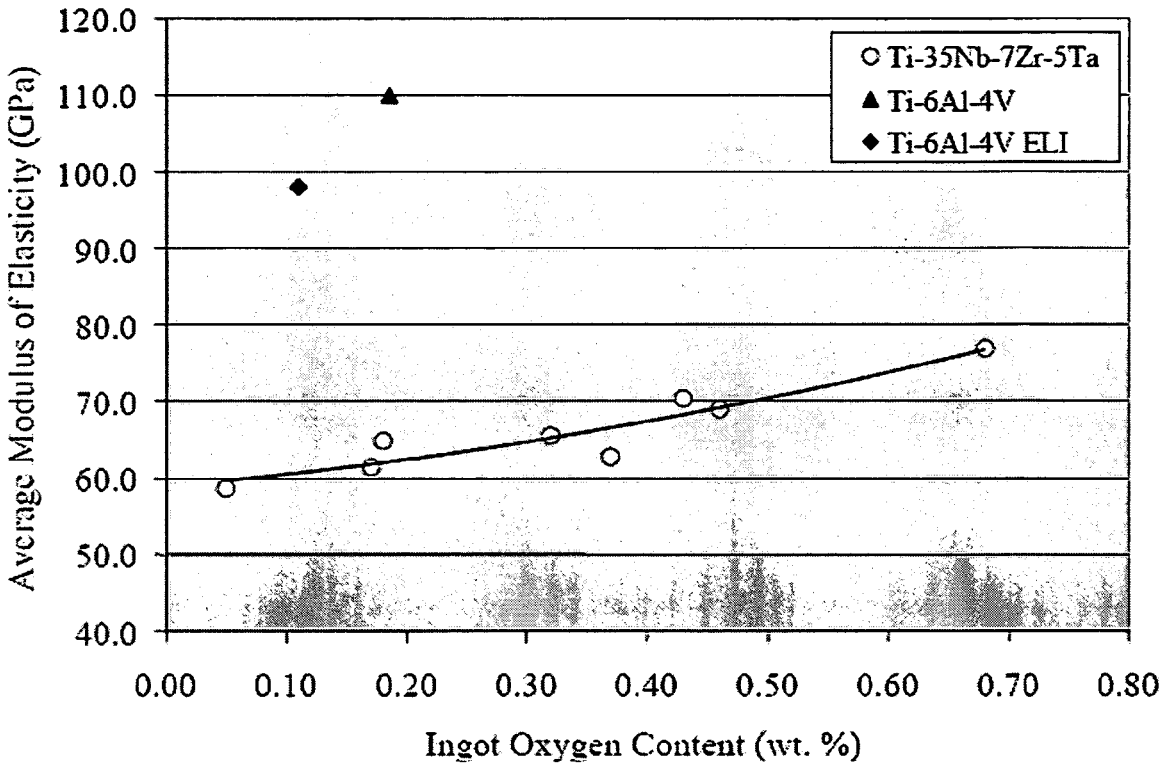
FIG. 3 is graph plotting elastic modulus as a function of oxygen content for samples of Ti-35Nb-7Zr-5Ta alloy.

In addition to ductility, as shown in FIG. 3, modulus of elasticity of Ti-35Nb-7Zr-5Ta did not increase more than about 40% (from 59 GPa to about 78 GPa), while oxygen content increased from about 0.06% to about 0.75%, which is more than a ten-fold oxygen content increase. The findings that ductility was not degraded and that modulus of elasticity did not significantly increase as oxygen content increased, along with the close correlation between YS and oxygen content, were unexpected.

5. Implications to the Oxygen Content of Ti-15Mo Alloy

Based on the relationships revealed in the studies discussed above, increasing the oxygen content of Ti-15Mo alloy above the 0.20% maximum in ASTM specification F 2066-01 ("Standard Specification for Wrought Titanium-15 Molybdenum Alloy for Surgical Implant Applications (UNS R58150)") (See Table 5) should result in improved YS and UTS, without significantly reducing ductility of the alloy. However, as oxygen content of the alloy increases, ductility of the alloy is reduced. Thus, it is assumed that there exists an upper limit of oxygen content where ductility of the alloy is reduced to a level low enough to make the alloy unusable. In cases where alloy ductility is important, the oxygen content of the T-15Mo alloy according to the present disclosure preferably is no greater than 1.0 weight percent based on the total weight of the alloy. Also, considering the limited ductility data available to the present inventors, it appears that a Ti-15Mo alloy according to the present disclosure including greater than about 0.7 weight percent oxygen would have elongation less than 5%, which is a degree of ductility not acceptable for most conventional applications. Accordingly, a more preferable upper limit for oxygen is 0.7 weight percent, and even more preferably is no greater than 0.5 weight percent, based on the total weight of the alloy. On the other hand, because it is believed that alloy strength and fatigue properties increase with increasing oxygen content, certain embodiments of the alloys according to the present disclosure will include at least 0.25 weight percent oxygen based on total alloy weight. As such, for example, certain embodiments of the present alloys may include at least 0.25 up to 1.0 weight percent oxygen, at least 0.25 up to 0.7 weight percent oxygen, or 0.25 up to 0.5 weight percent oxygen, all based on total alloy weight. Upon considering the present disclosure, those having ordinary skill, without undue experimentation, may determine an optimal alloy oxygen content for certain applications to suitably balance the alloy's strength, fatigue, and ductility properties.

Titanium alloys used in medical, surgical, and certain other applications, and particularly in surgical implant applications, typically must have very high cyclic fatigue properties. Cyclic fatigue properties correlate reasonably well to YS in titanium alloys. Accordingly, based upon the data presented herein suggesting that increased oxygen content in Ti-15Mo alloy will increase YS of the alloy without reducing ductility, the inventors concluded that increasing oxygen content of Ti-15Mo beyond the 0.20 weight percent limit of ASTM F 2066-01 also will improve the cyclic fatigue properties of the alloy. More generally, the inventors concluded that increasing the oxygen content of Ti-15Mo beyond the 0.20 weight percent limit of ASTM F 2066-01 will significantly improve YS, UTS, cyclic fatigue properties, and perhaps other mechanical properties of the alloy, without significantly reducing ductility and without increasing elastic modulus to a problematic degree. Moreover, it also is believed that such a "high-oxygen content" version of a Ti-15Mo metastable β alloy will have the same or better corrosion resistance and biocompatibility (for example, osseointegratability) as an ASTM F 2066-01 alloy. Other properties, such as, for example, homogeneity, and microstructure, also may be improved by increasing oxygen content beyond the 0.20 weight percent limit in ASTM F 2066-01. In addition, a high-oxygen content alloy will be less difficult to produce and may be easier for medical device manufacturers to convert into saleable manufactured articles. The expected improved fatigue properties and the satisfactory ductility properties of the alloy are suitable for applications in "structural" orthopedics, certain cardiovascular devices, trauma devices, and dental and orthodontic devices.

In order to confirm the conclusion that fatigue properties of Ti-15Mo metastable β alloy will be improved by increasing oxygen content of the alloy beyond 0.20 weight percent, and without increasing ductility or elastic modulus in a way problematic to, for example, surgical implant applications, two heats of high-oxygen content Ti-15Mo metastable β alloy were prepared for evaluation of mechanical properties. Semi-finished billets of the alloy of each heat were sampled at several locations to determine the chemistry of each billet. The chemistry of the several samples taken from each billet, the average chemistry, and the standard deviation among the samples are shown in tables 10 and 11 below, in which the heats are referred to as heats #1 and #2. The oxygen aim for heat #1 was 0.35 weight percent, and for heats #2 was 0.50 weight percent. Carbon content was not evaluated, although the ASTM F 2066-01 range for carbon is 0.10 weight percent max. According to the results in Tables 10 and 11, the chemistries of each of heats #1 and #2 are within the specification limits of F 2066-01, with the exception of oxygen and carbon, which was not measured.

TABLE 10

| | Molybdenum (wt. %) | Iron (wt. %) | Hydrogen (wt. %) | Nitrogen (wt. %) | Oxygen (wt. %) | Titanium (wt. %) | Sample Location |
|---|---|---|---|---|---|---|---|
| | 14.614 | 0.024 | 0.0006 | 0.0006 | 0.324 | 85.362 | Bottom Surface 1 |
| | 14.810 | 0.024 | 0.0010 | 0.0010 | 0.338 | 85.166 | Bottom Surface 2 |
| | 14.595 | 0.025 | 0.0008 | 0.0008 | 0.356 | 85.380 | Bottom Center |
| | 14.350 | 0.027 | 0.0004 | 0.0004 | 0.347 | 85.623 | Top Surface 1 |
| | 14.481 | 0.027 | 0.0012 | 0.0012 | 0.344 | 85.492 | Top Surface 2 |
| | 14.383 | 0.026 | 0.0008 | 0.0008 | 0.342 | 85.591 | Top Center |
| Average (wt. %) | 14.539 | 0.026 | 0.0008 | 0.0008 | 0.342 | 85.436 | |
| Std. Dev. | 0.171 | 0.001 | 0.0003 | 0.0003 | 0.011 | 0.169 | |
| F2066 (wt. % min.) | 14.000 | 0.000 | 0.0000 | 0.0000 | 0.000 | 83.535 | |
| F2066 (wt. % max.) | 16.000 | 0.100 | 0.0150 | 0.0500 | 0.200 | 86.000 | |
| Ave. 2066 (wt. %) | 15.000 | 0.050 | 0.0075 | 0.0250 | 0.100 | 84.768 | |

TABLE 11

| | Molybdenum (wt. %) | Iron (wt %) | Hydrogen (wt. %) | Nitrogen (wt. %) | Oxygen (wt. %) | Titanium (wt. %) | Sample Location |
|---|---|---|---|---|---|---|---|
| | 14.326 | 0.033 | 0.0017 | 0.0030 | 0.530 | 85.641 | Top Surface 1 |
| | 14.389 | 0.030 | 0.0024 | 0.0020 | 0.548 | 85.581 | Top Surface 2 |
| | 14.318 | 0.031 | 0.0050 | 0.0040 | 0.477 | 85.651 | Top Center |
| | 14.741 | 0.025 | 0.0021 | 0.0040 | 0.482 | 85.234 | Bottom Surface 1 |
| | 14.836 | 0.023 | 0.0034 | 0.0020 | 0.408 | 85.141 | Bottom Surface 2 |
| | 14.799 | 0.025 | 0.0043 | 0.0040 | 0.506 | 85.176 | Bottom Center |
| Average (wt. %) | 14.568 | 0.028 | 0.0032 | 0.0032 | 0.492 | 85.404 | |
| Std. Dev. | 0.248 | 0.004 | 0.0013 | 0.0010 | 0.049 | 0.244 | |
| F2066 (wt. % min.) | 14.000 | 0.000 | 0.0000 | 0.0000 | 0.000 | 83.535 | |
| F2066 (wt. % max.) | 16.00 | 0.100 | 0.0150 | 0.0500 | 0.200 | 86.000 | |
| Ave. 2066 (wt. %) | 15.000 | 0.050 | 0.0075 | 0.0250 | 0.100 | 84.768 | |

Tensile testing was conducted on solution-treated specimens from as-rolled "black bar" material from each heat, before final straightening, centerless grinding, or peeling/polishing. Both titanium ingots were rotary forged to produce nominal 4.000 inch diameter billets. The billets were rolled to nominal 0.500 inch diameter bar on a continuous rolling mill at ATI Allvac (Richburg, S.C.). The two bar lots were then randomly sampled to obtain representative tensile specimens. Table 12 provides the tensile test results for the material of heat #1, which included about 0.35 weight percent oxygen. Results listed in the table include the following room temperature properties of the tensile specimens recorded during testing: modulus of elasticity (E), ultimate tensile strength (UTS), yield strength (YS), elongation (EL), and reduction of area (RA). Table 12 provides results for 10 individual samples of the bar of heat #1 material, wherein each sample was (i) solution-treated at a temperature at or above the beta transus temperature of heat #1, and then (ii) tensile tested at room temperature. The rightmost column of Table 12 lists the solution-treatment temperature used for the particular bar specimen.

Table 13 provides the tensile test results for the material of heat #2, which included about 0.50 weight percent oxygen. Table 13 provides results for 10 individual samples of the bar of heat #2 material, wherein each sample was (i) solution-treated at a temperature at or above the beta transus temperature of heat #2, and then (ii) tensile tested at room temperature. The rightmost column of Table 13 lists the solution-treatment temperature used for the particular bar specimen. Each of Tables 12 and 13 also lists the minimum acceptable values for the tensile properties indicated in ASTM F 2066-01.

TABLE 12

| Heat #1 Material | | | | | | |
|---|---|---|---|---|---|---|
| Test Temp. (° F.) | E (Mpsi) | UTS (ksi) | YS (0.2% offset, ksi) | % EL | % RA | Treat Temp. (° F.) |
| Room | 10.1 | 172.0 | 166.2 | 15.4 | 53.2 | 1550 |
| Room | 10.3 | 172.4 | 166.2 | 15.6 | 54.0 | 1550 |
| Room | 10.3 | 172.1 | 165.8 | 16.1 | 52.7 | 1575 |
| Room | 10.6 | 172.1 | 165.8 | 16.5 | 49.7 | 1575 |
| Room | 9.7 | 171.5 | 165.9 | 15.5 | 53.6 | 1600 |
| Room | 10.3 | 173.1 | 167.5 | 13.6 | 47.7 | 1600 |
| Room | 10.0 | 169.4 | 164.0 | 15.3 | 52.9 | 1625 |
| Room | 10.5 | 173.4 | 167.2 | 14.9 | 50.0 | 1625 |
| Room | 10.1 | 172.5 | 166.2 | 14.2 | 45.7 | 1650 |
| Room | 10.3 | 173.5 | 167.0 | 15.1 | 51.9 | 1650 |
| Average | 10.2 | 172.2 | 166.2 | 15.2 | 51.1 | — |
| Standard Deviation | 0.3 | 1.2 | 1.0 | 0.8 | 2.8 | — |
| F 2066 minimum | N/a | 100.0 | 70.0 | 20.0 | 60.0 | — |

TABLE 13b

| Heat #2 Material | | | | | | |
|---|---|---|---|---|---|---|
| Test Temp. (° F.) | E (Mpsi) | UTS (ksi) | YS (0.2% offset, ksi) | % EL | % RA | Heat Treat Temp. (° F.) |
| Room | 10.6 | 179.4 | 173.5 | 15.3 | 41.8 | 1625 |
| Room | 10.5 | 183.0 | 177.2 | 14.6 | 42.2 | 1625 |
| Room | 10.8 | 179.0 | 173.6 | 16.8 | 45.5 | 1650 |
| Room | 10.2 | 185.6 | 177.3 | 16.8 | 46.7 | 1650 |
| Room | 10.0 | 182.6 | 177.1 | 15.7 | 47.0 | 1675 |
| Room | 10.8 | 179.7 | 173.9 | 15.8 | 43.6 | 1675 |
| Room | 10.2 | 180.8 | 174.9 | 16.0 | 46.5 | 1700 |
| Room | 10.8 | 176.6 | 171.7 | 15.4 | 46.4 | 1700 |
| Room | 10.6 | 177.3 | 172.0 | 14.0 | 43.0 | 1725 |
| Room | 10.0 | 183.6 | 177.3 | 15.4 | 43.6 | 1725 |
| Average | 10.5 | 180.8 | 174.8 | 15.6 | 44.6 | — |
| Standard Deviation | 0.3 | 2.9 | 2.2 | 0.9 | 2.0 | — |
| F 2066 minimum | N/a | 100.0 | 70.0 | 20.0 | 60.0 | — |

To better facilitate a comparison between the mechanical properties of the high-oxygen content Ti-15Mo alloys according to the present disclosure and a similar alloy including a conventional oxygen content, Table 14 provides mechanical properties of multiple samples of conventional Ti-15Mo β titanium alloys in the beta annealed condition as per ASTM F 2066-01. The samples in Table 14 are of alloys from two different heats, heat A and heat B, and the tensile test samples were prepared from bars of the indicated diameters. Table 14 also provides the average UTS, YS, EL, ROA and E for the samples derived from each of heats A and B and for all samples, as well as the minimum acceptable values for the tensile properties indicated in ASTM F 2066-01. The oxygen content of heat A was 0.137%, and for heat B was 0.154%. Thus, the alloys of heats A and B included less than 0.20 weight percent oxygen, as is conventional under ASTM F 2066-01.

TABLE 14

| Conventional Ti—15Mo Alloys | | | | | | |
|---|---|---|---|---|---|---|
| Bar Diameter (inches) | Heat | UTS (ksi) | YS (0.2% offset, ksi) | % EL | % RA | Average E (Mpsi) |
| 0.2500 | A | 108.5 | 67.6 | 51.6 | 84.9 | 10.0 |
| 0.2500 | A | 108.1 | 66.6 | 50.0 | 85.4 | |
| 0.2500 | A | 107.9 | 64.2 | 51.6 | 84.6 | |
| 0.2500 | A | 108.5 | 64.7 | 51.6 | 83.7 | |
| 0.3150 | B | 109.8 | 92.5 | 42.9 | 70.7 | |
| 0.3150 | B | 108.9 | 88.1 | 42.3 | 74.7 | |
| 0.3150 | B | 117.0 | 86.1 | 45.9 | 69.1 | |
| 0.3150 | B | 116.3 | 86.9 | 45.9 | 72.4 | |
| 0.3150 | B | 109.3 | 79.5 | 53.4 | 75.6 | |
| 0.3150 | B | 112.2 | 83.2 | 45.9 | 72.7 | |
| 0.5110 | B | 111.2 | 85.7 | 35.9 | 77.9 | |
| 0.5110 | B | 113.6 | 92.5 | 34.9 | 77.4 | |
| 0.5110 | B | 110.2 | 88.1 | 36.4 | 77.9 | |
| 0.5110 | B | 109.3 | 81.6 | 37.6 | 77.9 | |
| 1.0000 | A | 115.9 | 109.0 | 32.0 | 78.0 | |
| 1.0000 | A | 118.7 | 116.2 | 30.7 | 72.6 | |
| 1.0000 | A | 108.9 | 86.1 | 37.4 | 79.0 | |
| 1.0000 | A | 112.9 | 99.4 | 43.0 | 76.9 | |
| Average - Heat A | | 111.2 | 84.2 | 43.5 | 80.6 | 10.0 |
| Std. Deviation | | 4.1 | 21.5 | 9.0 | 4.7 | N/a |
| Average - Heat B | | 111.8 | 86.4 | 42.1 | 74.6 | 10.0 |
| Std. Deviation | | 3.0 | 4.2 | 5.9 | 3.3 | N/a |
| Average - All Data | | 111.5 | 85.5 | 42.7 | 77.3 | 10.0 |
| Std. Deviation | | 3.4 | 14.2 | 7.3 | 4.9 | N/a |
| F 2066 minimum | | 100.0 | 70.0 | 20.0 | 60.0 | N/a |

Figure 4:
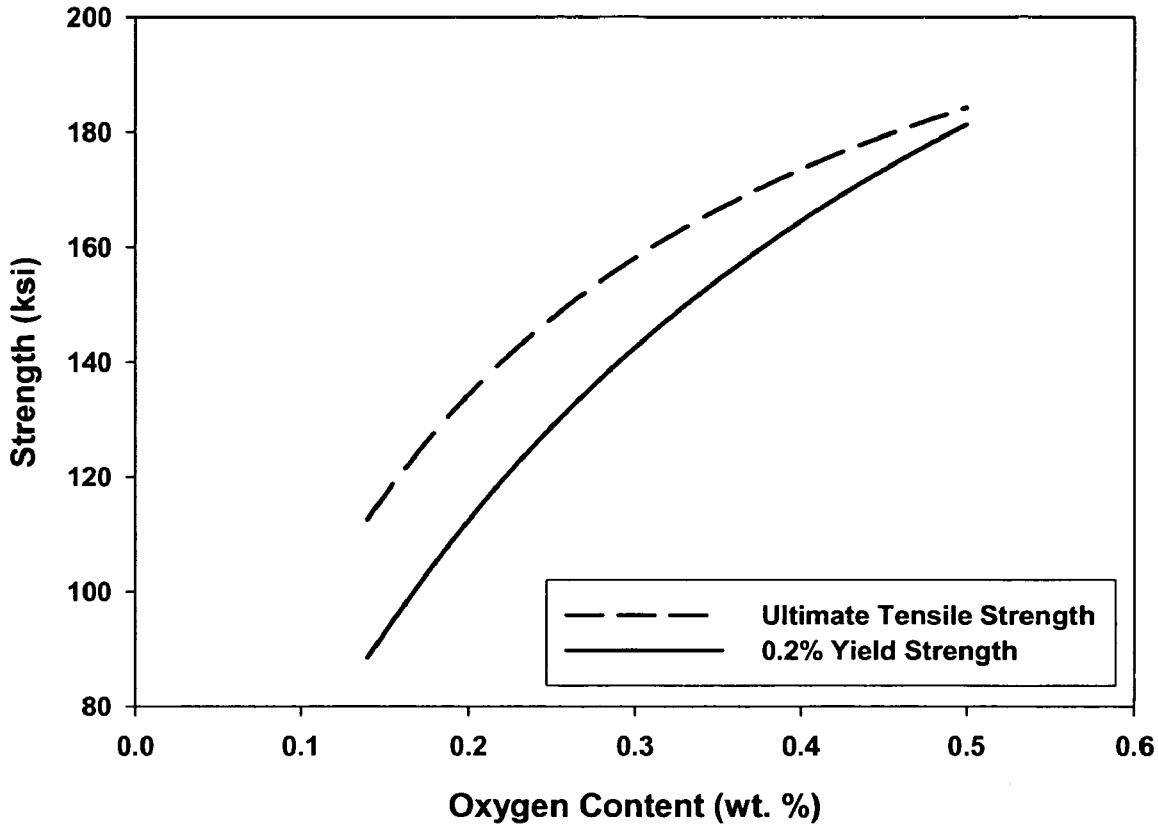
FIG. 4 is a graph plotting ultimate tensile strength and 0.2% yield strength as a function of oxygen content for certain titanium-base alloys described herein.

Table 15 directly compares the tensile results listed in Tables 12, 13, and 14, comparatively showing that the UTS and YS values for the alloys according to the present disclosure having about 0.35 and about 0.50 weight percent oxygen are significantly greater than for the conventional Ti-15Mo alloy material, and that UTS and YS increase with increasing oxygen content. FIG. 4 is a least squares curve of UTS and YS as a function of oxygen content using the data in Tables 14 (less than 0.20 weight percent oxygen), 12 (about 0.35 weight percent oxygen), and 13 (about 0.50 weight percent oxygen). FIG. 4 graphically illustrates the trend of increasing UTS and YS with increasing oxygen content for a Ti-15Mo type alloy.

Given the greater UTS and YS of the two high-oxygen content Ti-15Mo alloys of heats #1 and #2, it is expected that, in general, the high cycle corrosion fatigue properties (for example, high cycle fatigue resistance and endurance limit) for these alloys will be improved relative to the fatigue properties of a conventional, i.e., "low oxygen", Ti-15Mo alloy (0.20 weight percent oxygen or less) in the beta annealed condition. Also, it is believed that the improvement in fatigue properties will increase with increased oxygen content. Moreover, given the significant improvement in UTS and YS exhibited for the heats #1 and #2 materials relative to the conventional T-15Mo material samples (see Table 15), it is expected that the improvement in fatigue properties for the high-oxygen alloys of heats #1 and #2 also will be significant. It also follows from the data in Table 15 that one may provide a Ti-15Mo type alloy having particular UTS and YS and, thus, desired fatigue (or corrosion fatigue) resistance properties, by suitably adjusting the oxygen content of the material at levels in excess of 0.20 weight percent. In this way, a "family" of high-strength, high-fatigue resistance Ti-15Mo type alloys having substantially the same composition, but varying strength and fatigue resistance properties, can be provided.

Figure 5:
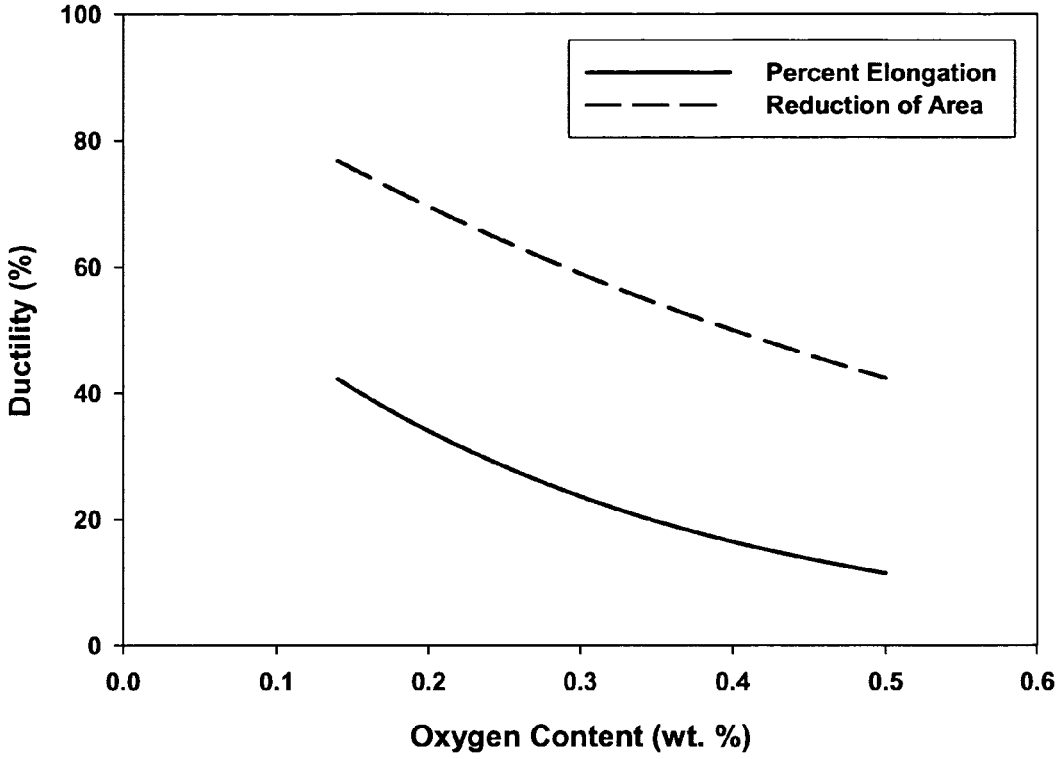
FIG. 5 is a graph plotting ductility (both percent elongation and reduction of area) as a function of oxygen content for certain titanium-base alloys described herein.
Figure 6:
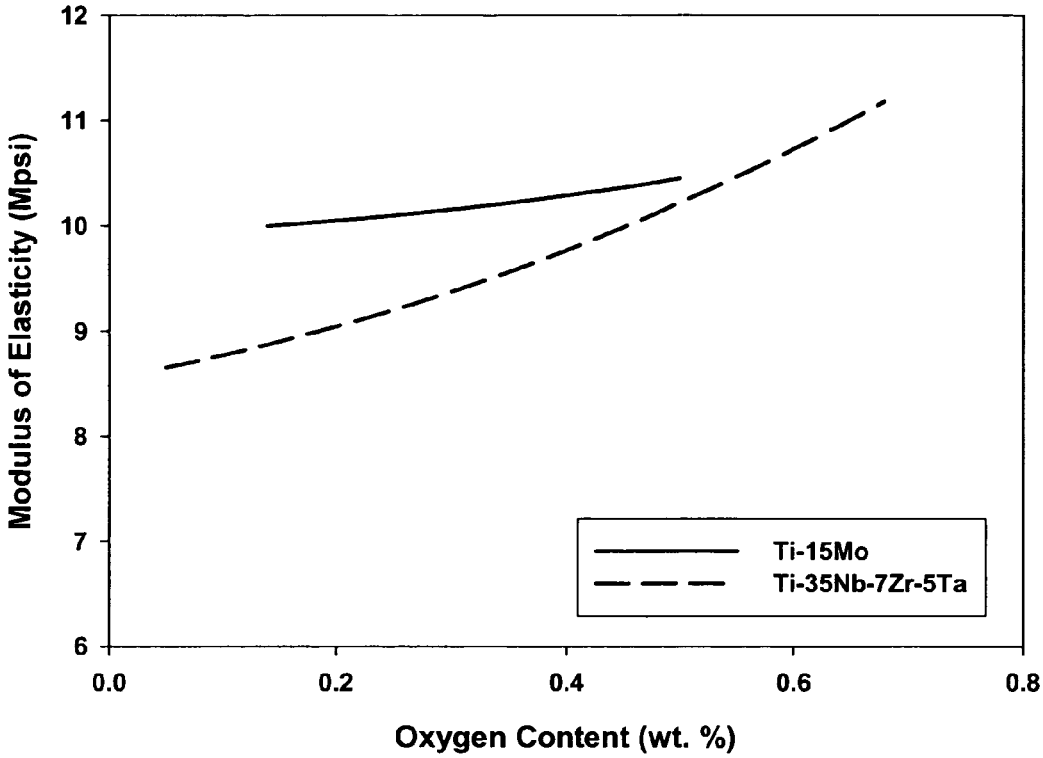
FIG. 6 is a graph plotting modulus of elasticity as a function of oxygen content for certain titanium-base alloys described herein as well as Ti-35Nb-7Zr-5Ta β titanium alloy.

Elongation and reduction of area data presented herein, such as listed in Table 15 and shown graphically in FIG. 5, demonstrate that embodiments of the high-oxygen content alloy according to the present disclosure have favorable ductility properties. As discussed above, however, as oxygen content of the alloy increases, ductility is reduced. In cases where alloy ductility is important, the oxygen content of the T-15Mo alloy according to the present disclosure preferably is no greater than 1.0 weight percent based on the total weight of the alloy. Also, based on extrapolation from the limited ductility data available to the present inventors, a Ti-15Mo alloy according to the present disclosure including more than about 0.7 weight percent oxygen would have elongation less than 5%, which is not acceptable for most conventional applications of Ti-15Mo type alloys. Accordingly, a more preferable upper limit for oxygen is 0.7 weight percent, and an even more preferable upper limit is no greater than 0.5 weight percent, based on the total weight of the alloy.

On the other hand, because strength and fatigue properties of alloys according to the present disclosure increase with increasing oxygen content, certain embodiments of the present alloys will include at least 0.25 weight percent oxygen based on total alloy weight. Considering the effects of increasing oxygen content on strength, fatigue properties, and ductility, certain non-limiting embodiments of alloys according to the present disclosure include at least 0.25 up to 1.0 weight percent oxygen, at least 0.25 up to 0.7 weight percent oxygen, or 0.25 up to 0.5 weight percent oxygen, all based on total alloy weight.

TABLE 15

Tensile Properties Comparison

| Oxygen Content (wt. %) | UTS (ksi) | YS (0.2% offset, ksi) | % EL | % RA |
|---|---|---|---|---|
| 0.14 | 111.5 | 85.5 | 42.7 | 77.3 |
| 0.35 | 172.2 | 166.2 | 15.2 | 51.1 |
| 0.50 | 180.8 | 174.8 | 15.6 | 44.6 |
| F 2066 minimum | 100.0 | 70.0 | 20.0 | 60.0 |

Strength and ductility properties of the high-oxygen content Ti-15Mo alloys of the present disclosure compare favorably with certain commercially available materials used in biomedical applications. One example of such an alloy is TMZF® β titanium alloy (UNS R58120), which is produced in an annealed condition by ATI Allvac (Monroe, N.C.) for Stryker Orthopaedics (Mahwah, N.J.). The nominal composition of TMZF® alloy, in weight percentages, is as follows: 0.02 max. carbon; 2.0 iron; 0.02 max. hydrogen; 12.0 molybdenum; 0.01 nitrogen; 0.18 oxygen; 6.0 zirconium; remainder zirconium. Reported typical mechanical properties of TMZF® alloy are: 145 ksi ultimate tensile strength; 140 ksi 0.2% offset yield strength; 13% elongation; and 40% reduction of area. Thus, it is observed that the average UTS, YS, EL, and RA listed in Table 15 for the high-oxygen Ti-15Mo material of heats #1 and #2 exceed the TMZF® alloy's reported typical properties.

Accordingly, one aspect of the present disclosure is directed to certain modified Ti-15Mo alloys including greater than the 0.20 weight percent maximum oxygen content specified in ASTM F 2066-01. Certain embodiments of the novel alloys of the present disclosure may satisfy all of the requirements of UNS R58150 and/or ASTM F 2066-01, with the exception being that the novel alloys include in excess of 0.20 weight percent oxygen as discussed herein. As discussed above, it is believed that providing greater than 0.20 weight percent oxygen in the alloys described herein will improve certain mechanical properties of the alloys important to medical, surgical, and other applications. Such mechanical properties include, for example, YS, UTS, and cyclic fatigue properties, without significantly compromising ductility (as evidenced by elongation and reduction of area values) and modulus of elasticity.

Embodiments of alloys according the present disclosure may be advantageously applied in biomedical (i.e., medical and/or surgical) applications such as, for example: partial and total joint replacement procedures; fracture fixation in trauma cases; cardiovascular procedures; restorative and reconstructive dental procedures; spinal fusion and spinal disc replacement procedures. Specific non-limiting examples of possible surgical implant devices and parts with which embodiments of the alloys described in the present disclosure may be used include: components for partial and total hip and knee replacement; intermedullary rods; fracture plates, spinal fixation and spinal disc replacement components; trauma screws and plates; wires and cables; fasteners and screws; nails and anchors; dental castings and implants; orthodontic arch wires and anchors; heart valve rings and components; profile and plate stocks; tools and instruments; and miscellaneous fasteners and hardware.

Moreover, embodiments of alloys according to the present disclosure may be advantageously applied in certain non-biomedical applications including, for example equipment and parts used in one or more of the following applications: aerospace applications; automotive applications; nuclear applications; power generation applications; jewelry; and chemical processing applications. Specific non-limiting examples of possible non-surgical equipment and parts with which embodiments of the alloys described herein may be used include: automotive torsions bars; aerospace fasteners; corrosion-resistant thin sheet for military and commercial aircraft; high performance racing and motorcycle springs; and corrosion-resistant chemical processing tubing and fasteners.

Those having ordinary skill in the art will be capable of fabricating the foregoing articles of manufacture from the alloys according to the present disclosure as such knowledge exists within the art. Accordingly, further discussion of fabrication procedures for such articles is unnecessary here.

The foregoing examples of possible applications for alloys according to the present disclosure are offered by way of example only, and are not exhaustive of all applications to which the present alloys may be applied. Those having ordinary skill, upon reading the present disclosure, may readily identify additional applications for the alloys described herein. Also, those having ordinary skill in the art will be capable of fabricating the foregoing articles of manufacture from the alloys according to the present disclosure, as such knowledge exists within the art. Accordingly, further discussion of possible fabrication procedures for such articles is unnecessary here.

Although the foregoing description has necessarily presented only a limited number of embodiments, those of ordinary skill in the relevant art will appreciate that various changes in the apparatus and methods and other details of the examples that have been described and illustrated herein may be made by those skilled in the art, and all such modifications will remain within the principle and scope of the present disclosure as expressed herein and in the appended claims. It will also be appreciated by those skilled in the art that changes could be made to the embodiments above without departing from the broad inventive concept thereof. It is understood, therefore, that this invention is not limited to the particular embodiments disclosed, but it is intended to cover modifications that are within the principle and scope of the invention, as defined by the claims.

We claim:

1. A metastable β titanium alloy comprising, in weight percentages based on total alloy:
up to 0.05 nitrogen;
up to 0.10 carbon;
up to 0.015 hydrogen;
up to 0.10 iron;
0.25 oxygen up to 0.50 oxygen;
14.00 to 16.00 molybdenum;
at least 83.54 titanium; and
incidental impurities;
wherein the metastable β titanium alloy further comprises a yield strength in a range of 128 ksi to 181 ksi and a modulus of elasticity in a range of 10.1 Mpsi to 10.5 Mpsi.

2. The metastable β titanium alloy of claim 1, wherein, with the sole exception of oxygen content, the alloy has the composition of UNS R58150.

3. The metastable β titanium alloy of claim 1, wherein, with the exception of oxygen content and the provisions of Section 9.1 under "Special Requirements" requiring a fully recrystallized beta phase structure, the alloy satisfies all of the requirements of ASTM F 2066-01 for wrought Ti-15Mo alloy suitable for use in the manufacture of surgical implants.

4. The metastable β titanium alloy of claim 1, wherein the alloy exhibits at least one of yield strength and ultimate tensile strength that is greater than a second alloy processed in an identical manner and, with one exception, having an identical chemistry, wherein the one exception is that the second alloy includes no greater than 0.20 weight percent oxygen.

5. The metastable β titanium alloy of claim 1, wherein the alloy has improved cyclic fatigue properties relative to a second alloy processed in an identical manner and, with one exception, having an identical chemistry, wherein the one exception is that the second alloy includes no greater than 0.20 weight percent oxygen.

6. The metastable β titanium alloy of claim 1, having an ultimate tensile strength in a range of 148 ksi to 186 ksi.

7. A metastable β titanium alloy consisting essentially of, in weight percentages:
up to 0.05 nitrogen;
up to 0.10 carbon;
up to 0.015 hydrogen;
up to 0.10 iron;
0.25 up to 0.50 oxygen;
14.00 to 16.00 molybdenum;
remainder titanium; and
incidental impurities;
wherein the metastable β titanium alloy further comprises a yield strength in a range of 128 ksi to 181 ksi and a modulus of elasticity in a range of 10.1 Mpsi to 10.5 Mpsi.

8. The metastable β titanium alloy of claim 7, wherein the titanium content of the alloy is at least 83.5.

9. The metastable β titanium alloy of claim 7, wherein, with the sole exception of oxygen content, the alloy has the composition of UNS R58150.

10. The metastable β titanium alloy of claim 7, wherein, with the exception of oxygen content and the provisions of Section 9.1 under "Special Requirements" requiring a fully recrystallized beta phase structure, the alloy satisfies all of the requirements of ASTM F 2066-01 for wrought Ti-15Mo alloy suitable for use in the manufacture of surgical implants.

11. The metastable β titanium alloy of claim 7, wherein the alloy has at least one of yield strength and ultimate tensile strength that is greater than a second alloy processed in an identical manner and, with one exception, having an identical chemistry, wherein the one exception is that second alloy includes no greater than 0.20 weight percent oxygen based on the total weight of the second alloy.

12. The metastable β titanium alloy of claim 7, wherein the alloy has improved cyclic fatigue properties relative to a second alloy processed in an identical manner and, with one exception, having an identical chemistry, wherein the one exception is that second alloy includes no greater than 0.20 weight percent oxygen based on the total weight of the second alloy.

13. The metastable β titanium alloy of claim 7, having an ultimate tensile strength in a range of 148 ksi to 186 ksi.

14. A metastable β titanium alloy consisting of, in weight percentages:
up to 0.05 nitrogen;
up to 0.10 carbon;
up to 0.015 hydrogen;
up to 0.10 iron;
0.25 up to 0.50 oxygen;
14.00 to 16.00 molybdenum;
remainder titanium and incidental impurities;
wherein the metastable β titanium alloy further comprises a yield strength in a range of 128 ksi to 181 ksi and a modulus of elasticity in a range of 10.1 Mpsi to 10.5 Mpsi.

15. The metastable β titanium alloy of claim 14, wherein, with the sole exception of oxygen content, the alloy has the composition of UNS R58150.

16. The metastable β titanium alloy of claim 14, wherein the alloy has at least one of yield strength and ultimate tensile strength that is greater than a second alloy processed in an identical manner and, with one exception, having an identical chemistry, wherein the one exception is that the second alloy includes no greater than 0.20 weight percent oxygen.

17. The metastable β titanium alloy of claim 14, wherein the alloy has improved cyclic fatigue properties relative to a second alloy processed in an identical manner and, with one exception, having an identical chemistry, wherein the one exception is that the second alloy includes no greater than 0.20 weight percent oxygen.

18. The metastable β titanium alloy of claim 14, having an ultimate tensile strength in a range of 148 ksi to 186 ksi.

19. An article of manufacture comprising a metastable β titanium alloy having the composition recited in claim 1.

20. The article of manufacture of claim 19, wherein the article is one of an article of equipment, a part, and a component useful in at least one application selected from: partial and total joint replacement procedures; fracture fixation in trauma cases; cardiovascular procedures; restorative and reconstructive dental procedures; and spinal fusion and spinal disc replacement procedures.

21. The article of manufacture of claim 20, wherein the metastable β titanium alloy consists essentially of, in weight percentages:
up to 0.05 nitrogen;
up to 0.10 carbon;
up to 0.015 hydrogen;
up to 0.10 iron;
0.25 up to 0.50 oxygen;
14.00 to 16.00 molybdenum;
remainder titanium and incidental impurities;
wherein the metastable β titanium alloy further comprises a yield strength in a range of 128 ksi to 181 ksi and a modulus of elasticity in a range of 10.1 Mpsi to 10.5 Mpsi.

22. The article of manufacture of claim 20, wherein the metastable β titanium alloy consists of, in weight percentages:

up to 0.05 nitrogen;
up to 0.10 carbon;
up to 0.015 hydrogen;
up to 0.10 iron;
0.25 up to 0.5 oxygen;
14.00 to 16.00 molybdenum;
remainder titanium and incidental impurities;
wherein the metastable β titanium alloy further comprises a yield strength in a range of 128 ksi to 181 ksi and a modulus of elasticity in a range of 10.1 Mpsi to 10.5 Mpsi.

23. The article of manufacture of claim 20, wherein the metastable β titanium alloy has an ultimate tensile strength in a range of 148 ksi to 186 ksi.

24. The article of manufacture of claim 19, wherein the article is selected from the following biomedical components and parts: a component for partial and total hip and knee replacement; an intermedullary rod; a fracture plate; a spinal fixation replacement component; and spinal disc replacement component; a trauma screw; a trauma plate; a wire; a cable; a fastener; a screw; a nail; an anchor; a dental casting; a dental implant; an orthodontic arch wire; an orthodontic anchor; a heart valve ring; a heart valve component; profile and plate stocks; a tool; an instrument; a fastener; and an item of hardware.

25. The article of manufacture of claim 19, wherein the article is an article of equipment, a part, or a component useful in at least one application selected from: aerospace applications; automotive applications; nuclear applications; power generation applications; jewelry; and chemical processing applications.

26. The article of manufacture of claim 19, wherein the article is selected from the following components and parts: automotive torsions bars; aerospace fasteners; corrosion-resistant thin sheet for military and commercial aircraft; high performance racing and motorcycle springs; and corrosion-resistant chemical processing tubing and fasteners.

* * * * *